United States Patent [19]

Keultjes

[11] 4,226,391

[45] Oct. 7, 1980

[54] CHAIR SUPPORT

[76] Inventor: Henry B. Keultjes, Mansfield, Ohio

[21] Appl. No.: 673,127

[22] Filed: Apr. 2, 1976

[51] Int. Cl.[3] ..... F16M 11/00

[52] U.S. Cl. ..... 248/176

[58] Field of Search ..... 248/158, 159, 161, 176, 248/177, 404, 405, 406, 407, 408, 410, 411, 412, 413, 414, 415, 417, 418

[56] References Cited

U.S. PATENT DOCUMENTS

| | | | |
|---|---|---|---|
| 3,358,951 | 12/1967 | Carter | 248/407 X |
| 3,438,606 | 4/1969 | Rubin | 248/415 |
| 3,788,587 | 1/1974 | Stemmler | 248/404 X |

FOREIGN PATENT DOCUMENTS

| | | | |
|---|---|---|---|
| 1383656 | 11/1964 | France | 248/411 |

OTHER PUBLICATIONS

Tyndall, *Sound,* Fourth Edition, London, Longmans, Green & Co., 1883, pp. 136–157.

Wood, *A Textbook of Sound,* New York, The MacMillan Co., 1955, pp. 114–117 and 172–177.

*Primary Examiner*—William H. Schultz

[57] ABSTRACT

A chair support bracket formed from a dished plate having an opening therethrough in the center of the dished portion formed by a sleeve that is ring welded to the plate. The opening through the sleeve has a locking taper with the large diameter of the taper at its lower end to lock onto the tapered upper end of a pedestal. Unlocking of the support bracket from the pedestal is accomplished by vibration waves proceeding from the plate back down into the sleeve to impinge upon the locking tapered surface of the sleeve.

2 Claims, 3 Drawing Figures

CHAIR SUPPORT

BACKGROUND OF THE INVENTION

The present invention relates to supports for fixing the seat of a chair to the top of a pedestal. Many types of modern chairs and bar stools utilize a tubular pedestal plus a support bracket for fixing the seat of the chair to the top of the pedestal. In some of such chairs, the pedestal comprises a pneumatic strut arrangement, the piston of which extends upwardly out of the tubular body of the pedestal to receive the support bracket that is affixed to the chair. In some of these arrangements, a valve button projects out of the top end of the piston rod for controlling the degree of extension of the piston rod upwardly out of the tubular body of the pedestal. In some instances, the prior art has attached the support structure for the seat of the chair to the pedestal by means of a bridge structure having top and bottom rings which wedge upon a taper provided on the upper end of the pedestal. A disadvantage of such structures has been that they lock onto the pedestals so tightly, particularly after a prolonged period of usage, that they can not be removed from the pedestal without, in some instances, damaging either the bridge structure, or the pedestal, or both. When the pedestal comprises a pneumatic strut, damage can be done by pounding on the piston rod, or by putting a pipe wrench on the piston rod which slides in and out of the tubular body. A problem therefore exists, particularly for the housewife, in removing the chair structure from the pedestal without damaging the pedestal in any way.

An object of the present invention is the provision of a new and improved support for fixing the seat of a chair to the top of a pedestal using a locking taper on the top of the pedestal, and which support structure can be removed from the pedestal without damaging the support structure or the pedestal in any way.

DESCRIPTION OF THE PREFERRED EMBODIMENT

Figure 1:
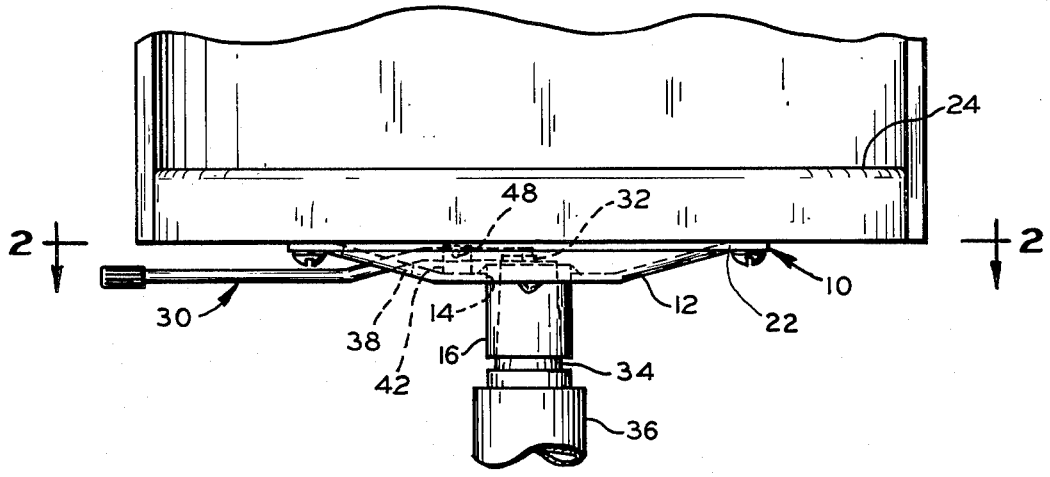
FIG. 1 is a fragmentary elevational view showing a chair support embodying principles of the present invention for attaching the seat of a chair to the top of a pneumatic pedestal having a locking taper on the top end of its piston rod.
Figure 2:
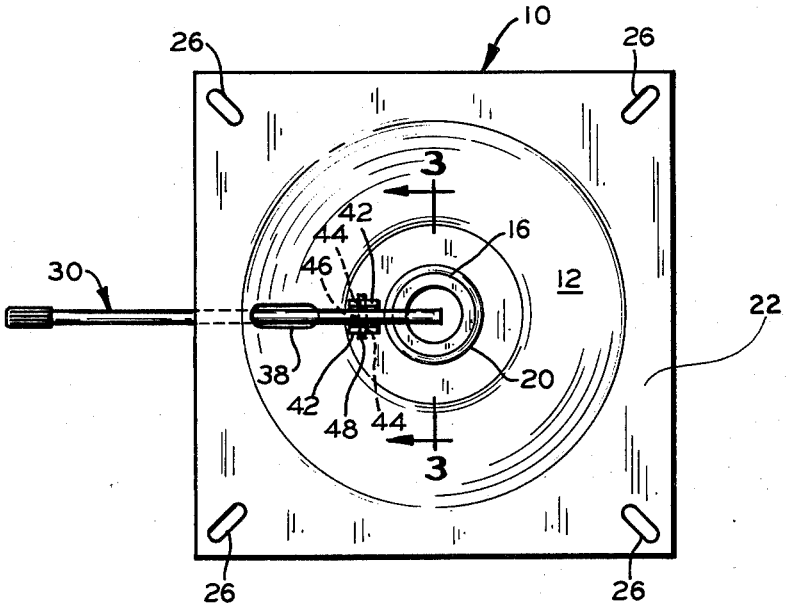
FIG. 2 is a sectional view taken approximately on the line 2—2 of FIG. 1, and showing the top end of the support structure.
Figure 3:
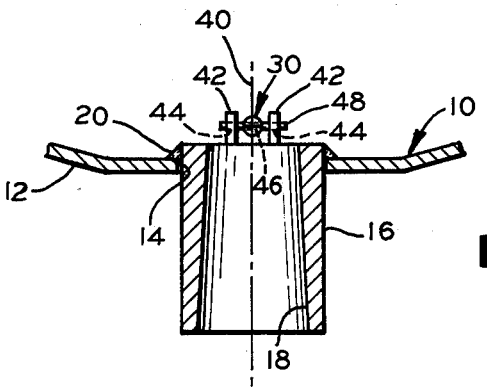
FIG. 3 is a fragmentary sectional view taken on the line 3—3 of FIG. 2.

The new and improved chair support bracket shown in the drawing generally comprises a generally square plate 10, the center of which has been dished downwardly as at 12 by a stamping operation to a depth of approximately one inch. The center of the plate 10 contains an opening 14 therethrough which receives a sleeve 16 that is approximately one and one-eighth inches in diameter and approximately one and one-quarter inch long. The opening 18 through the sleeve is tapered at an included angle of approximately two degrees with the large end of the taper being at the bottom. The sleeve 16 projects from the top surface of the plate 10 by approximately one-eighth inch, and a continuous ring fillet weld 20 is provided between the sleeve 16 and the plate 10 to provide a very rigid connection between the sleeve 16 and the plate 10. Vibrations will be transmitted from the sleeve 16 to the plate, and vice versa, unattenuated and in an uninterrupted manner, so that the sleeve and plate will vibrate as a unit.

The dished down portion 12 of the plate 10 extends to within approximately one-quarter of an inch of the four side surfaces of the plate to provide a small flat peripheral edge portion 22 around the plate for abutting the bottom of the seat 24. The dished portion is circular so that the flat peripheral shelf portion 22 adjacent the corners is slightly wider. Oblong shaped holes 26 are provided in each corner and extend radially for receiving screws or other suitable fasteners for holding the seat 24 down upon the peripheral edge portion 22 of the plate 10. For those instances wherein the support bracket is to be used for fastening the seat to the top end of a pneumatic strut, a control valve lever 30 is provided for depressing the valve button 32 that is usually provided on the top end of the piston rod 34. The valve rod 30 passes through an oblong opening 38 through the plate 10. The opening 38 is positioned in the dished portion 12 and is aligned radially with respect to the centerline 40 of the sleeve 16. The control rod 30 extends through the opening 38 and passes between a pair of uprights 42 that are welded to the top of the dished portion of the plate with the inner end of the rod extending over the center of the sleeve 16. Aligned openings 44 and 46 extend through the uprights 42 and rod 30, respectively, to receive a pivot pin 48. The inner end of the rod, including the uprights 42 are housed within the dished portion 12 of the plate where they are completely protected and out of sight.

According to principles of the present invention, it has been discovered that the structure of the present invention can be easily removed from the top of a spindle having a locking taper thereon by a vibration producing hammer blow upon the side of the sleeve 16. It appears that the vibration that is produced in the sleeve 16 radiates uniformly in rings from the sleeve through the plate 10 to its side edges. The side edges of the plate are a natural reflection point, or node, for the ring shaped vibrations, as are the square corners; so that the vibrations return to the sleeve at approximately the same instant without appreciable distortion or attenuation. Since the side edges of the plate are a nodal point, and therefore do not move appreciably; and because the soft structure of the seat only contacts the nodal shelf portion of the plate, no appreciable dampening effect occurs by reason of the attachment of the seat thereto. Because of the shape of the plate and the continuous ring weld between the sleeve and the plate, the vibration returning from the shelf nodal portion 22 concentrates back onto the sleeve 16. The vibration does not usually transfer from the sleeve to the pedestal but is concentrated onto the inner tapered surface of the sleeve.

The original impact of the hammer onto the sleeve 16 produces vibration both in the sleeve, and the pedestal. The shock waves proceding down the pedestal return to the top of the pedestal out of phase with the ring vibrations returning from the shelf nodal point, so that both are concentrated back onto the tapered sleeve surface 18 out of phase. A lengthwise pulling of the seat from the pedestal at the time that the reflected vibrations are concentrated on the surface 18 will unlock the sleeve from the top of the pedestal without damage to the support structure, pneumatic strut, pedestal, etc. With simple instructions, therefore, a housewife can remove the seat of the chair from the pedestal even though they are connected together by a locking taper.

In those instances where the seat is to be used with a pneumatic strut having a valve button 32 for controling the degree of projection of the piston rod 34 from the cylindrical housing 36, the control rod 30 is moved upwardly to bring the inner end of the lever downwardly onto the control button 32 to open the valve and permit collapse of the strut.

While the invention has been described in considerable detail, I do not wish to be limited to the particular embodiments shown and described; and it is my intention to cover hereby all novel adaptations, modifications, and arrangements thereof which come within the practice of those skilled in the art to which the invention relates.

I claim:

1. A support for fixing the seat of a chair to the top of a spindle having a locking taper thereon, said support comprising: a plate the center portion of which is dished downwardly below a peripheral portion extending around its side edges, said peripheral portion extending around its side edges, said peripheral portion providing a bearing surface to receive a chair seat, said center portion having a hole therethrough, a stiff sleeve the top end of which extends through said hole with the opening through said sleeve being positioned generally perpendicularly to said peripheral side edge portion of said plate, said opening of said sleeve having a taper that opens downwardly for locking engagement with the top end of a spindle, and said sleeve being of a thicker material than that of said plate, a continuous vibration transmitting ring weld between said sleeve and said plate, and whereby a sharp lateral blow on said sleeve produces vibration from the sleeve into said plate and back to the sleeve to help unlock the sleeve from a spindle received therein.

2. The support of claim 1 comprising: a pair of parallel uprights projecting upwardly from the inside of the dished down portion of said plate, said uprights straddling an imaginary line which intersects the opening through said sleeve, said plate having an oblong opening through said dished down portion of the plate and extending along said imaginary line, and a lever extending through said oblong opening, between said uprights and over said opening through said sleeve, means pivotally connecting said lever to said uprights, and whereby said lever can be used to operate a valve extending upwardly of said sleeve.

* * * * *